US012318018B2

(12) United States Patent
Fox

(10) Patent No.: US 12,318,018 B2
(45) Date of Patent: Jun. 3, 2025

(54) CONTAINER FOR RETAINING AND DISPENSING ITEMS

(71) Applicant: MAGOOLER, LLC, Berlin Heights, OH (US)

(72) Inventor: Jeremiah Quinn Fox, Berlin Heights, OH (US)

(73) Assignee: MAGOOLER, LLC, Berlin Heights, OH (US)

( * ) Notice: Subject to any disclaimer, the term of this patent is extended or adjusted under 35 U.S.C. 154(b) by 419 days.

(21) Appl. No.: 17/825,646

(22) Filed: May 26, 2022

(65) Prior Publication Data

US 2022/0378224 A1 Dec. 1, 2022

Related U.S. Application Data

(60) Provisional application No. 63/202,067, filed on May 26, 2021.

(51) Int. Cl.

| | |
|---|---|
| ***A47F 1/06*** | (2006.01) |
| ***F25D 25/00*** | (2006.01) |
| ***F25D 25/02*** | (2006.01) |

(52) U.S. Cl.

CPC ..... *A47F 1/06* (2013.01); *F25D 25/005* (2013.01); *F25D 25/021* (2013.01); *F25D 2331/805* (2013.01)

(58) Field of Classification Search

CPC ..... F25D 25/005

(Continued)

(56) References Cited

U.S. PATENT DOCUMENTS 4,941,327 A * 7/1990 Miles ..... A47F 3/0486 62/250
6,142,317 A * 11/2000 Merl ..... A47F 1/125 211/59.3

(Continued)

FOREIGN PATENT DOCUMENTS

CN 210169535 U 3/2020
EP 2599722 A1 6/2013

(Continued)

OTHER PUBLICATIONS

Written Opinion of the International Searching Authority dated Sep. 13, 2022.

*Primary Examiner* — Gene O Crawford
*Assistant Examiner* — Ayodeji T Ojofeitimi
(74) *Attorney, Agent, or Firm* — Jacob M. Ward; Ward Law Office LLC

(57) ABSTRACT

A container for retaining and dispensing items allows the user to easily retrieve the items. The container is top dispensing and dispenses items through the use of one or more spring members, which biases a tray within the container. The container may include elongated slots that align with load assist holes on the tray, which in turn may receive a rod that enables a user to manually depress the tray and quickly load the container with the items. The container may also be used with different types of holders, which allows the container to be stored upright or sideways inside of temperature control units. The main body of the container may have rails that can be slidably received by the holders, allowing the user to use one or more containers in any given space. A system and a method for using the container is also disclosed.

12 Claims, 8 Drawing Sheets

(58) Field of Classification Search
USPC ..... 221/192, 198, 226–227, 270–271, 279
See application file for complete search history.

(56) References Cited

U.S. PATENT DOCUMENTS

| | | | | |
|---|---|---|---|---|
| 6,769,566 | B1 * | 8/2004 | Rubin | A47F 1/06 221/56 |
| 10,182,686 | B2 * | 1/2019 | Chen | A47K 10/18 |
| 11,064,819 | B2 | 7/2021 | Cooper et al. | |
| 2006/0273102 | A1 * | 12/2006 | Wieser | A47K 10/422 221/56 |
| 2008/0093376 | A1 | 4/2008 | Balkin | |
| 2011/0315707 | A1 * | 12/2011 | Kleinhuber | A47K 10/185 221/282 |
| 2013/0037562 | A1 * | 2/2013 | Close | A47F 1/126 206/774 |
| 2016/0374524 | A1 * | 12/2016 | Stenberg | B65D 83/0817 221/59 |

FOREIGN PATENT DOCUMENTS

| | | | |
|---|---|---|---|
| FR | 2558442 | A1 | 7/1985 |
| KR | 101504876 | B1 | 3/2015 |

* cited by examiner

CONTAINER FOR RETAINING AND DISPENSING ITEMS

CROSS-REFERENCE TO RELATED APPLICATIONS

This application claims the benefit of U.S. Provisional Application No. 63/202,067, filed on May 26, 2021. The entire disclosure of the above application is hereby incorporated herein by reference.

FIELD

The present disclosure relates to containers for holding items and, more specifically, containers for storage and temperature control of items such as cans and bottles.

INTRODUCTION

This section provides background information related to the present disclosure which is not necessarily prior art.

Beverage containers are typically dispersed by dumping the beverage containers directly into an open ice chest and covering them in ice, which does not allow for viewing or access of product. This may require the user to rummage through the ice chest, creating disarray. Thus, there is a need for an improved container for beverages.

Repeatedly opening ice chests and other refrigeration units may also interfere with the operation of the ice chest or refrigeration unit. While interior containers may allow the user to take out a container with one or more beverages, interior containers do not have a means for dispensing the beverages. Moreover, interior containers for ice chests are oftentimes attached to the upper portion of the outer container or the inner surface of the lid, suspending the interior container in the ice chest, and thereby preventing contents from contacting ice and being chilled effectively.

Currently, many refrigeration units use sloping shelves which allow consumers to take the lowermost product to allow one or more beverages to slide down through the influence of gravity, replacing the lowermost product. However, these shelves are typically built into the body or the door of the refrigeration unit and are not portable. What is more, taking the lowermost product of a refrigerated product may be inconvenient, particularly in outdoor settings.

There is a continuing need for a container that is suitable for retaining and dispensing items such as beverages, and which allows a user to conveniently take out one or more of the items at once, and which is also simple and top dispensing for placement into a temperature control unit like a cooler, an ice chest, a refrigeration unit, a heater, or an oven. Desirably, the container allows the user to easily retrieve individual or multiple items from the temperature control unit or another container, and also allows the user to dispense the items with ease once the container is taken out of the temperature control unit or another container, and further the permits the contents to contact the coldest parts of an ice chest or refrigeration unit when the temperature control unit is the ice chest or refrigeration unit.

SUMMARY

In concordance with the instant disclosure, a container that is suitable for retaining and dispensing items such as beverages, and which allows a user to conveniently take out one or more of the items at once, and which is also simple and top dispensing for placement into a temperature control unit like a cooler, an ice chest, a refrigeration unit, a heater, or an oven, and also which allows the user to easily retrieve individual or multiple items from the temperature control unit or another container, and further which allows the user to dispense the items with ease once the container is taken out of the temperature control unit or another container, and which further the permits the contents to contact the coldest parts of an ice chest or refrigeration unit when the temperature control unit is the ice chest or refrigeration unit, has been surprisingly discovered.

The present technology includes articles of manufacture, systems, and processes that relate to a container for retaining and dispensing items.

In one embodiment, a container for retaining and dispensing items includes a main body, a tray, and at least one spring member. The main body has a cavity configured for the retaining of the items. The main body has a top side, a bottom side, a first side, a second side, a first end, and a second end. The top side of the main body has a dispensing opening. The dispensing opening is configured for the dispensing of the items. The tray is selectively movably disposed within the cavity of the main body. The tray is configured to support the items. The tray has a tray body with an upper surface, a bottom surface, a first tray end, a second tray end, a first tray side, and a second tray side. The at least one spring member is coupled to the main body and the tray. The at least one spring member is configured to bias the tray toward the top side of the main body and to selectively move the tray toward the top side of the main body upon dispensing of the items by a user from the dispensing opening.

In another embodiment, a container system for retaining and dispensing items includes a first container and a holder. The first container includes a main body, a tray, and at least one spring member. The main body has a cavity configured for the retaining of the items. The main body has a top side, a bottom side, a first side, a second side, a first end, and a second end. The top side of the main body has a dispensing opening. The dispensing opening is configured for the dispensing of the items. The tray is selectively movably disposed within the cavity of the main body. The tray is configured to support the items. The tray has a tray body with an upper surface, a bottom surface, a first tray end, a second tray end, a first tray side, and a second tray side. The at least one spring member is coupled to the main body and the tray. The at least one spring member is configured to bias the tray toward the top side of the main body and to selectively move the tray toward the top side of the main body upon dispensing of the items by a user from the dispensing opening. The holder selectively secures the first container in a stored position.

In a further embodiment, a method for retaining and dispensing items is provided. The method providing a container having a main body, a tray and at least one spring member. The main body has a cavity configured for the retaining of the items. The main body has a top side, a bottom side, a first side, a second side, a first end, and a second end. The top side of the main body has a dispensing opening configured for the dispensing of the items. The tray is selectively movably disposed within the cavity of the main body and configured to support the items. The tray has a tray body with an upper surface, a bottom surface, a first tray end, a second tray end, a first tray side, and a second tray side. The at least one spring member is coupled to the main body. The tray is configured to bias the tray toward the top side of the main body and to selectively move the tray toward the top side of the main body upon dispensing of the items by a user from the dispensing opening. The method further includes loading the container with the items by inserting the items through the dispensing opening and onto the tray. The method then requires manually removing individual ones of the items from the container through the dispensing opening, whereby the tray is automatically caused to move toward the top side of the main body to position other ones of the items for dispensing.

In an exemplary embodiment, the disclosure relates to item containers and, more particularly, to a magazine style containment for item containers (which include cans, bottles, etc.). Embodiments of the present invention can also be placed within another container. The problem addressed by the present disclosure generally relates to the dispensing of items, such as cans, bottles, and other items or item containers.

Broadly, an embodiment of the present disclosure provides a receptacle for stacking and dispensing item containers that is in the form of a housing and a biased sleeve guide. The present disclosure allows for easy loading and unloading of cans, bottles or other item containers to access from a cooler or other to make them readily available. Various items can be retained within the present disclosure in an organized manner, compared to dumping item containers directly into an ice box or other receptacle for items as is conventional.

A containment/body is provided for item containers to be arranged in parallel manner or a perpendicular manner to a sidewall of the sleeve. The body may be configured such that it has a snap or locking mechanism to directly connect to a cooler or a refrigerator. A top stop is fastened to the top of the body and serves to act as a stop for the items when they are to be dispensed from the body. The top stop, while it may be shown as a separate part, may also be embodied as integral with the body. A sleeve guide is movably disposed within the body. Its structure allows parallel or perpendicular arrangement of item containers. The sleeve guide is movable up and down the body via wheels/guides disposed on both sides of the sleeve guide. An elastic device biases the sleeve guide upwards, and may be embodied in various ways, such as but not limited to, a steel, rubber, or other material spring. It will be readily apparent to those with skill in the art that the illustrated embodiments may have their configurations varied to retain and dispense various quantities of item containers.

To reconfigure the container of the present disclosure, placement and alternate designs of the body and sleeve guide can accommodate more or less item containers, or different angles of the items, or parallel or perpendicular configurations of the items for disbursement of the product. Beyond just items, embodiments of the present invention may be configured to dispense any number of materials.

A method of making the container of the present disclosure includes providing all of the aforementioned structure and assembling it using various appropriate means. A method of using the present invention may include the following steps, for example. The device may be placed within a cooler or other container and, due to the organized nature of the items loaded into the device, will allow for visibility, displacement, and availability of ready to use item containers.

DRAWINGS

The drawings described herein are for illustrative purposes only of selected embodiments and not all possible implementations, and are not intended to limit the scope of the present disclosure.

Figure 1:
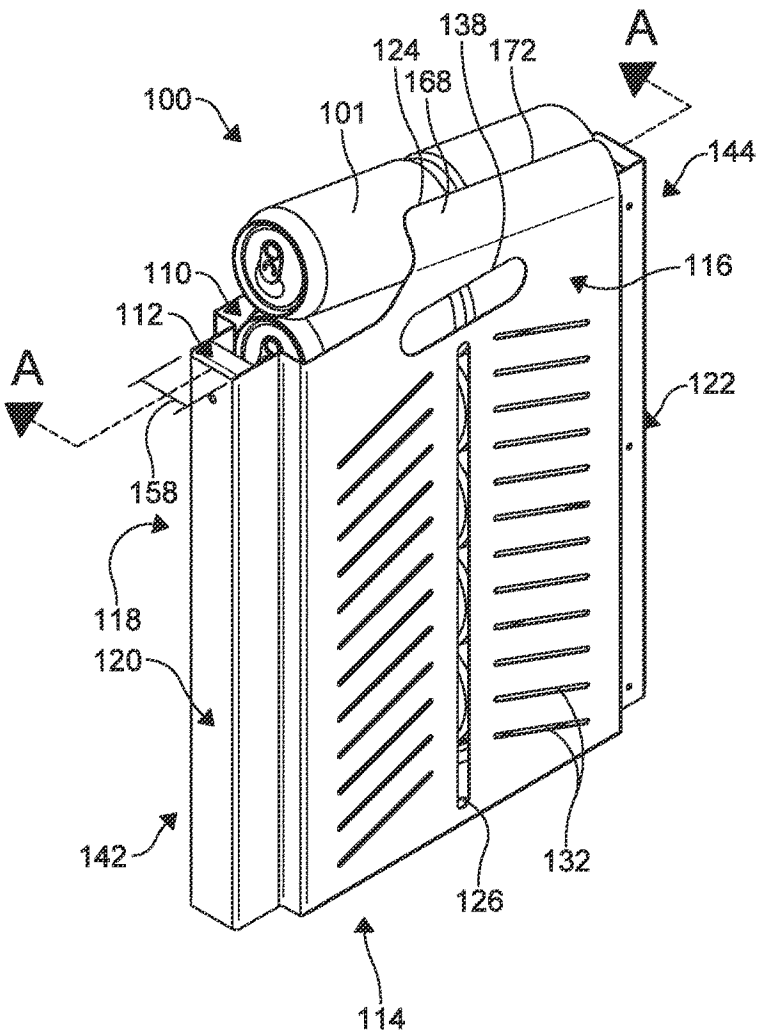
FIG. 1 is a top perspective view of a container for retaining and dispensing items, in accordance with one embodiment of the present disclosure.
Figure 11:
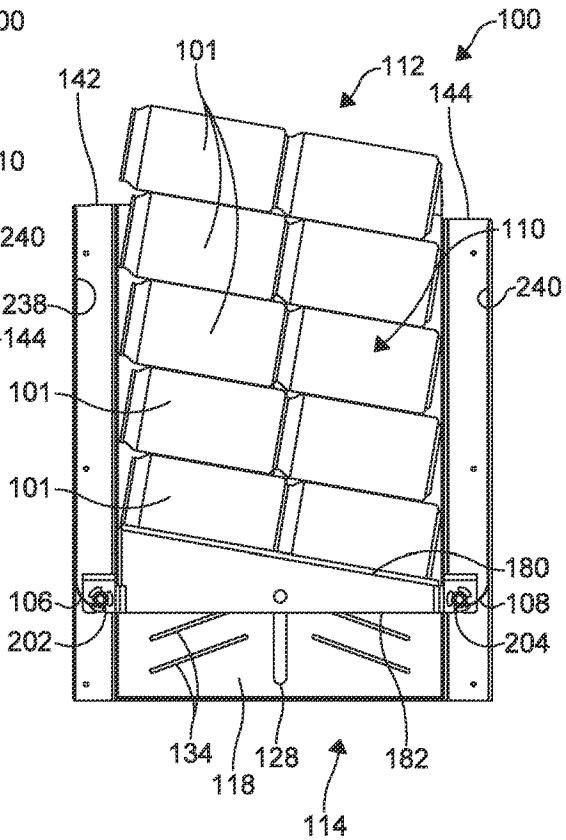
Figure 12:
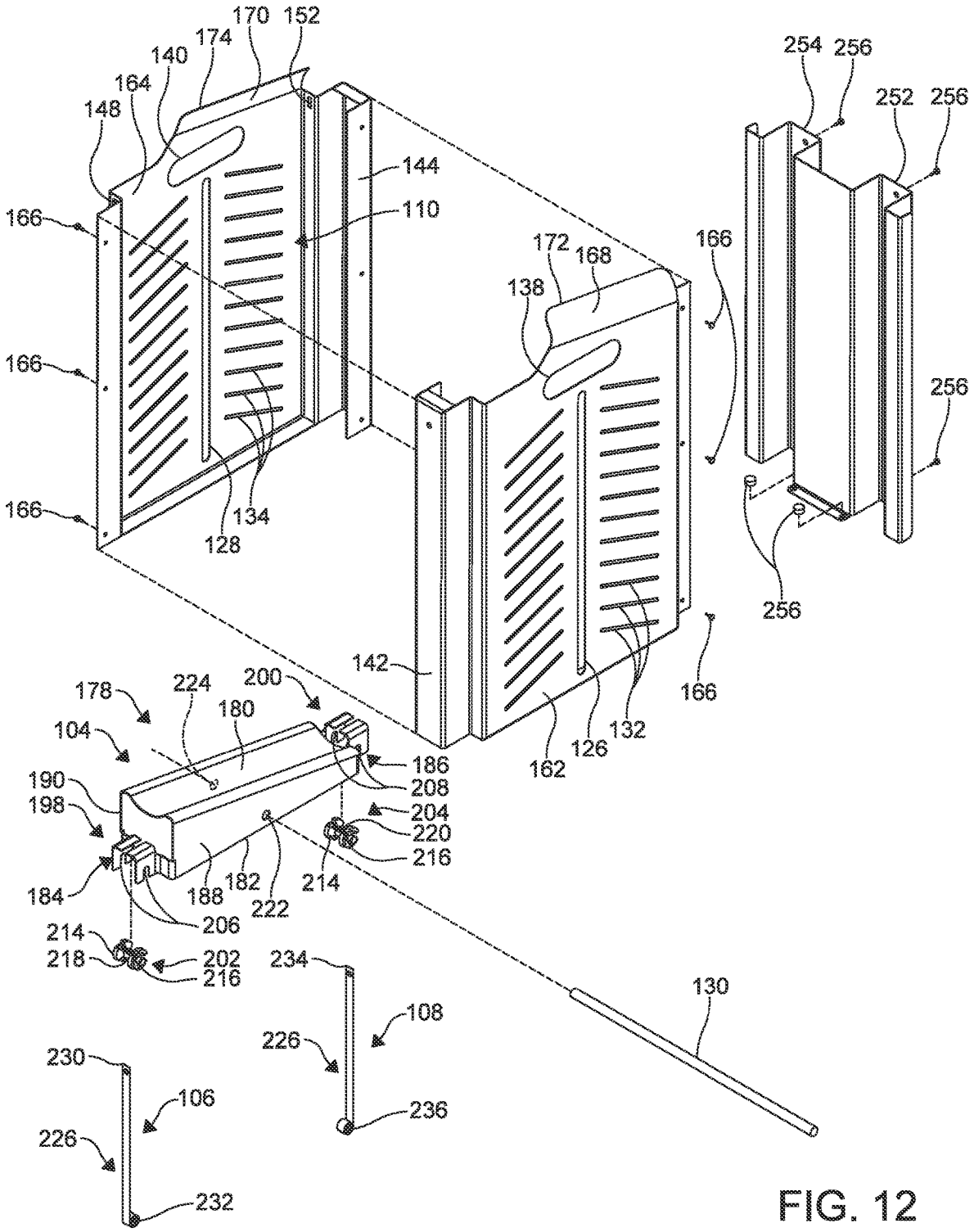
Figure 13:
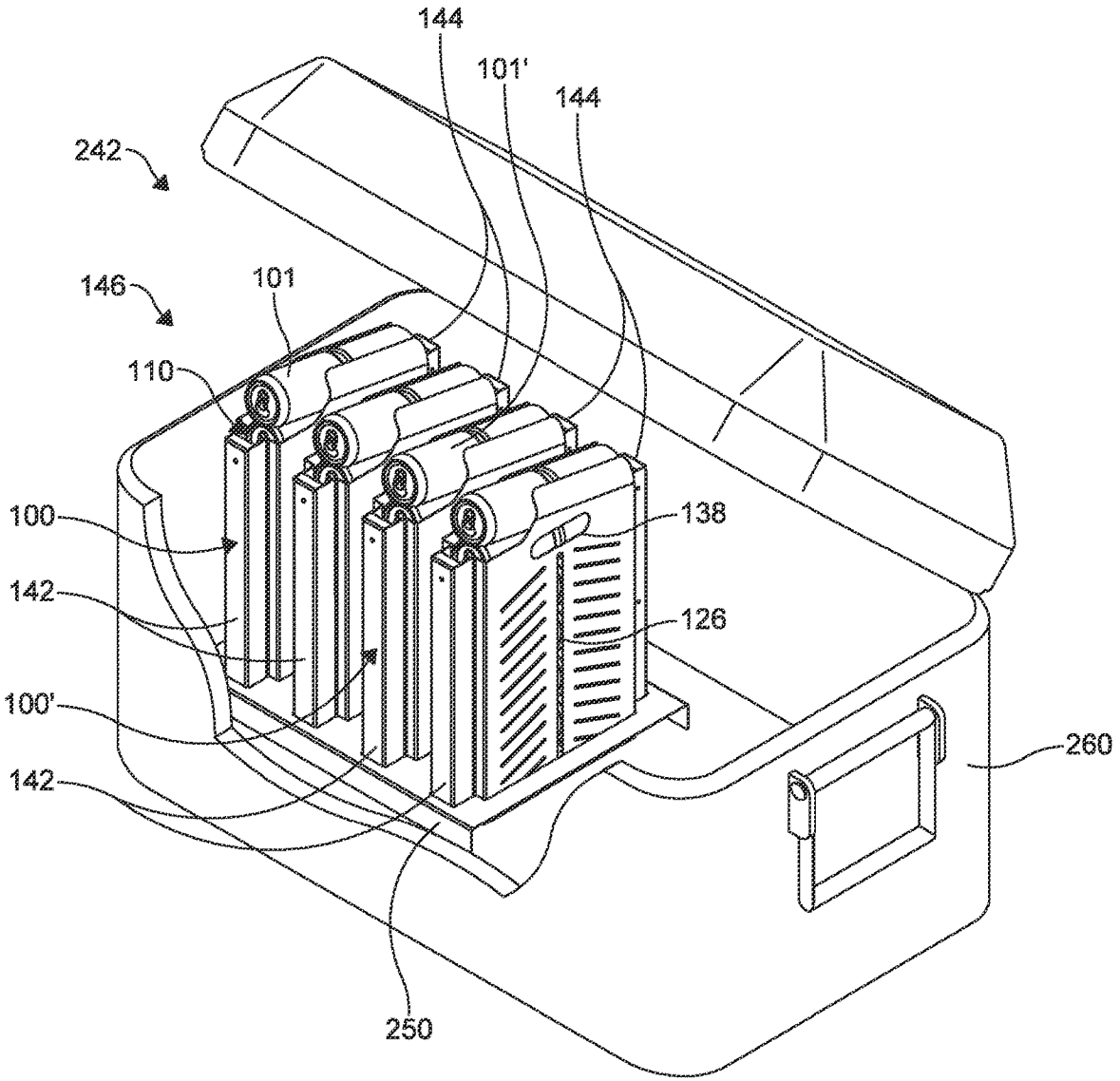
Figure 14:
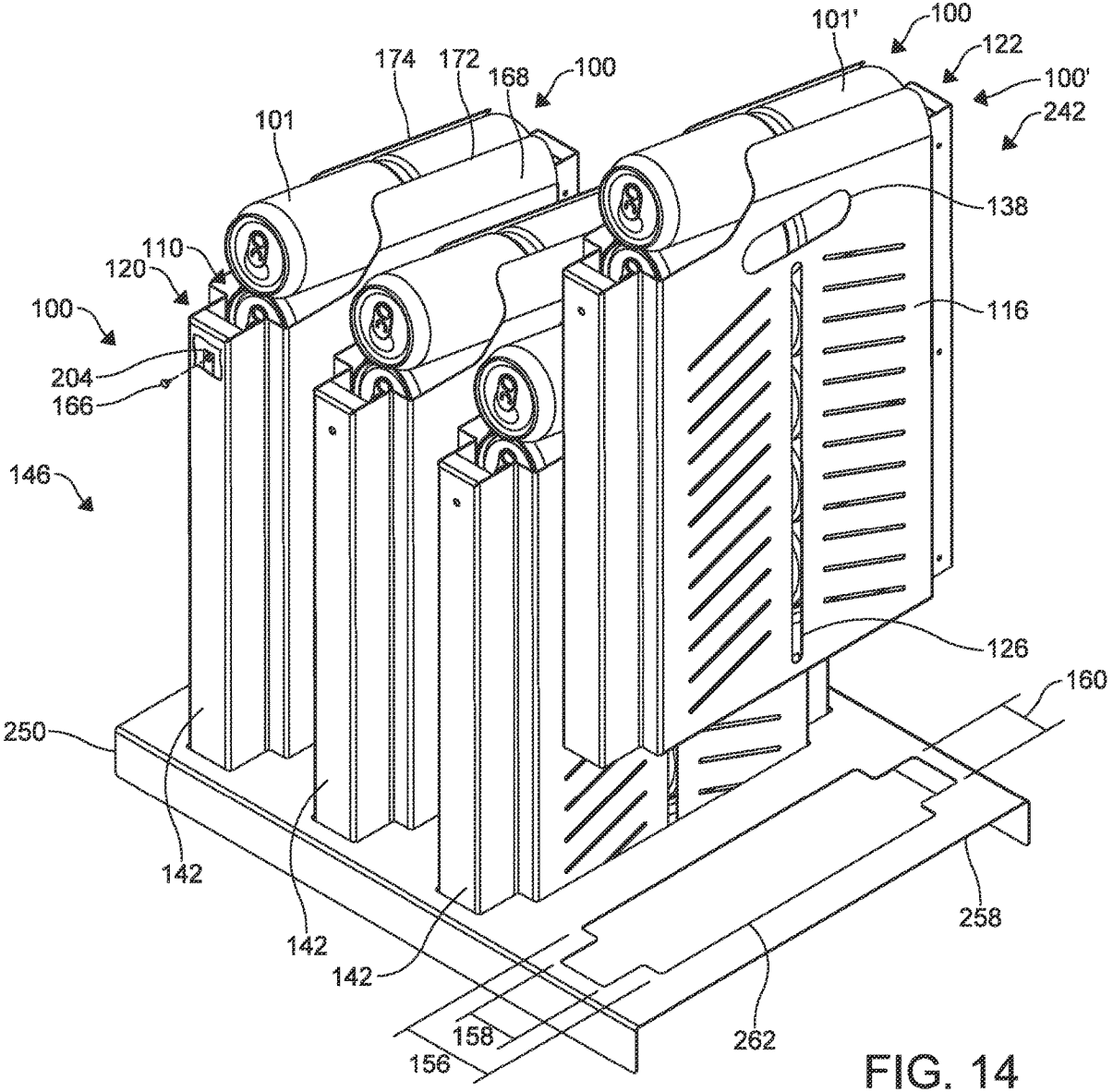
Figure 15:
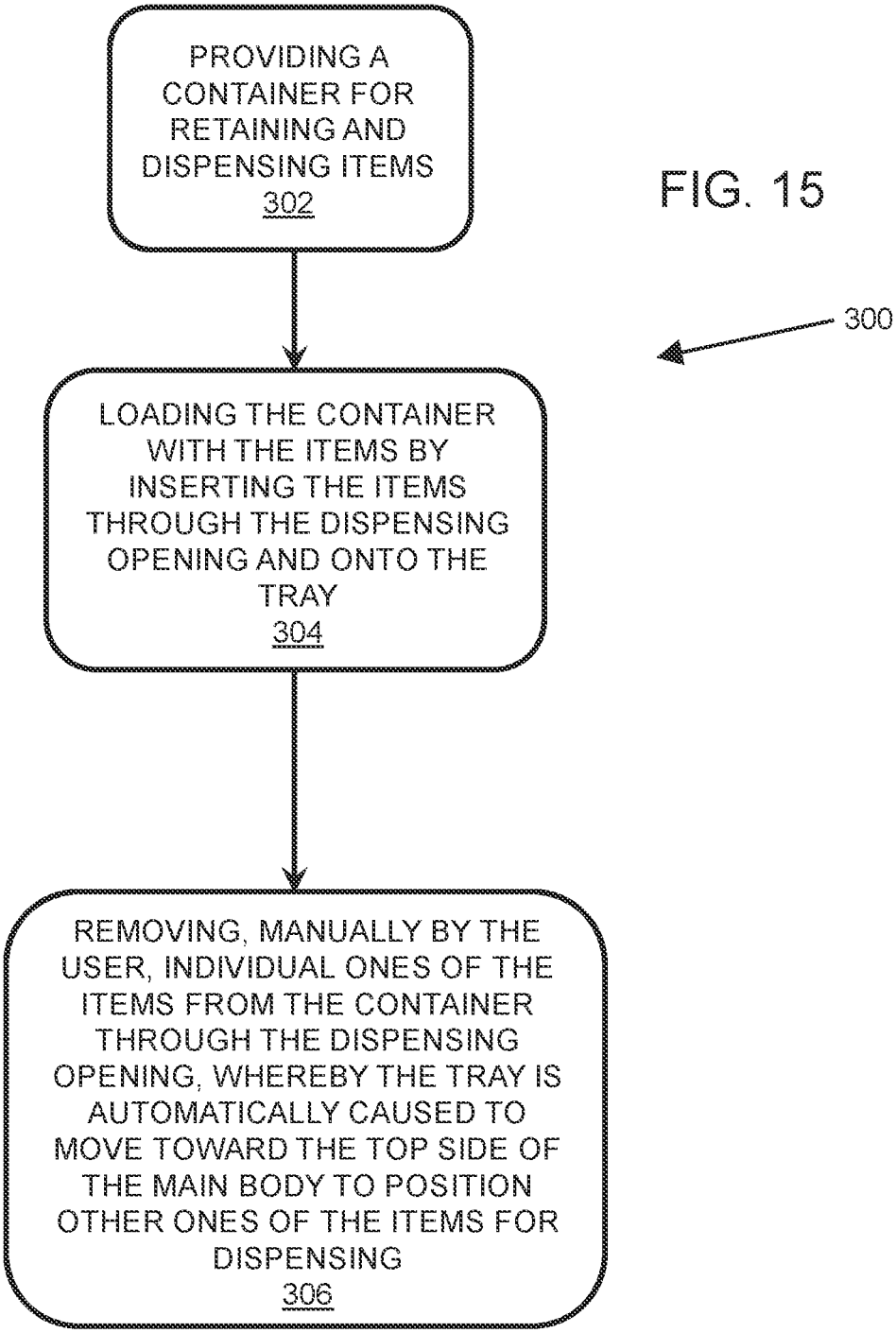

FIG. 11 a cross-sectional right side elevational view of the container for retaining and dispensing items taken at section line A-A in FIG. 1, and showing the tray having been advanced toward a top of the container, with the springs being partly extended;

FIG. 12 is an exploded top perspective view of the container for retaining and dispensing items shown in FIG. 1, and also showing a holder or bracket for holding the container, and further showing a load assist rod for use in a loading operation for the container;

FIG. 13 is a top perspective view of a holder or cooler having a plurality of the containers disposed therein in an upright orientation;

FIG. 14 is a top perspective view of a holder having a plurality of the containers disposed in recesses of the holder in an upright orientation, the containers nested in the recesses; and FIG. 15 is a method for loading and dispensing items utilizing the container for retaining and dispensing items shown in FIG. 1, according to one embodiment of the disclosure.

DETAILED DESCRIPTION

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

In accordance with the present technology, and as shown in FIGS. 1-14, a container 100 for retaining and dispensing items 101 is described. Although the items 101 described herein may include canned or bottled beverages in particular examples, it should be appreciated that other suitable types of the items 101 including perishable goods such as solid foods and soups, and nonperishable goods such as motor oils, may be employed with the container 100 of the present disclosure. In particular, the container 100 includes a main body 102, a tray 104, and at least one spring member 106, 108. The container 100 is configured for retaining and dispensing the items 101 and enables a user to retrieve the items 101 from holders, coolers, and other containers or container systems 242, 252, 254, 250 (shown in FIGS. 12-14). A container system 242 for using the container 100 is shown in FIGS. 12-14. A method 300 for loading the container 100 is further shown in FIG. 15.

As shown in FIGS. 1-14, the main body 102 has a cavity 110 configured for the retaining of the items 101. The main body 102 may be formed from any suitable material including metals and plastics, as non-limiting examples. The main body 102 has a top side 112, a bottom side 114, a first side 116, a second side 118, a first end 120, and a second end 122. The top side 112 of the main body may have a dispensing opening 124 configured for dispensing the items 101.

Referring now to FIGS. 1-3, and 11-14, the container 100 for retaining and dispensing the items 101 may further have a first elongate slot 126 on the first side 116, and a second elongate slot 128 on the second side 118. Each of the first elongate slot 126 and the second elongate slot 128 may be disposed between the top side 112 and the bottom side 114 of the main body 102. Each of the first elongate slot 126 and the second elongate slot 128 may be configured to be used with a load assist rod 130 (for example, as shown in FIG. 12). The load assist rod 130 facilitates a loading of the cavity 110 of the main body 102 with the items 101, for example, as described further herein with respect to the method 300 shown in FIG. 15.

Figure 2:
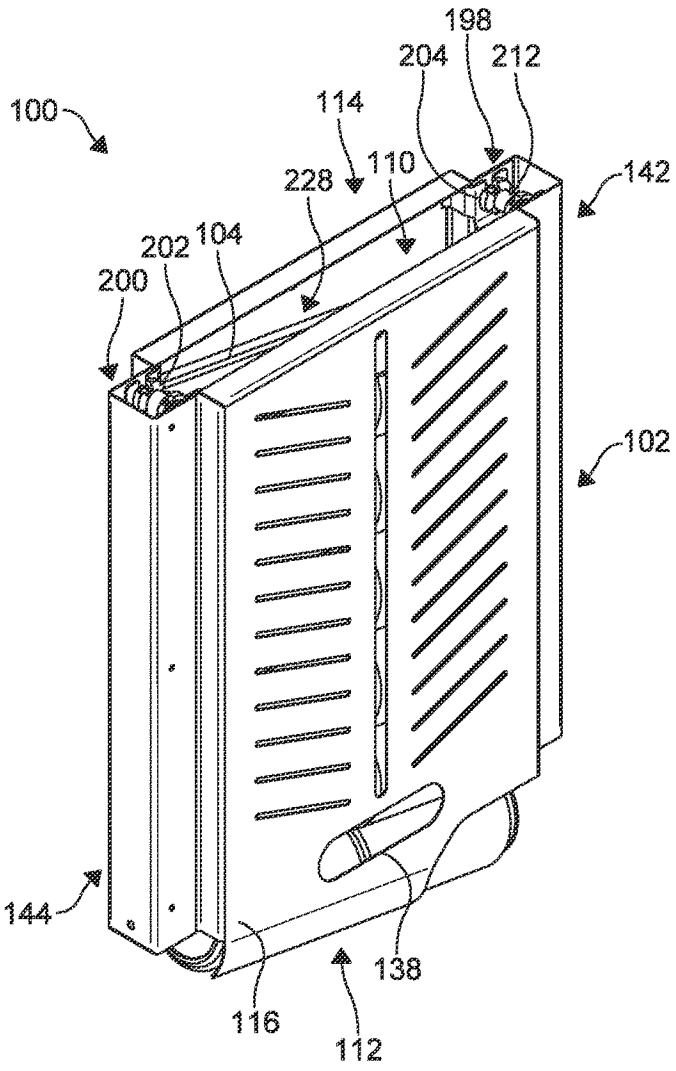
FIG. 2 is a bottom perspective view of the container for retaining and dispensing items shown in FIG. 1.
Figure 3:
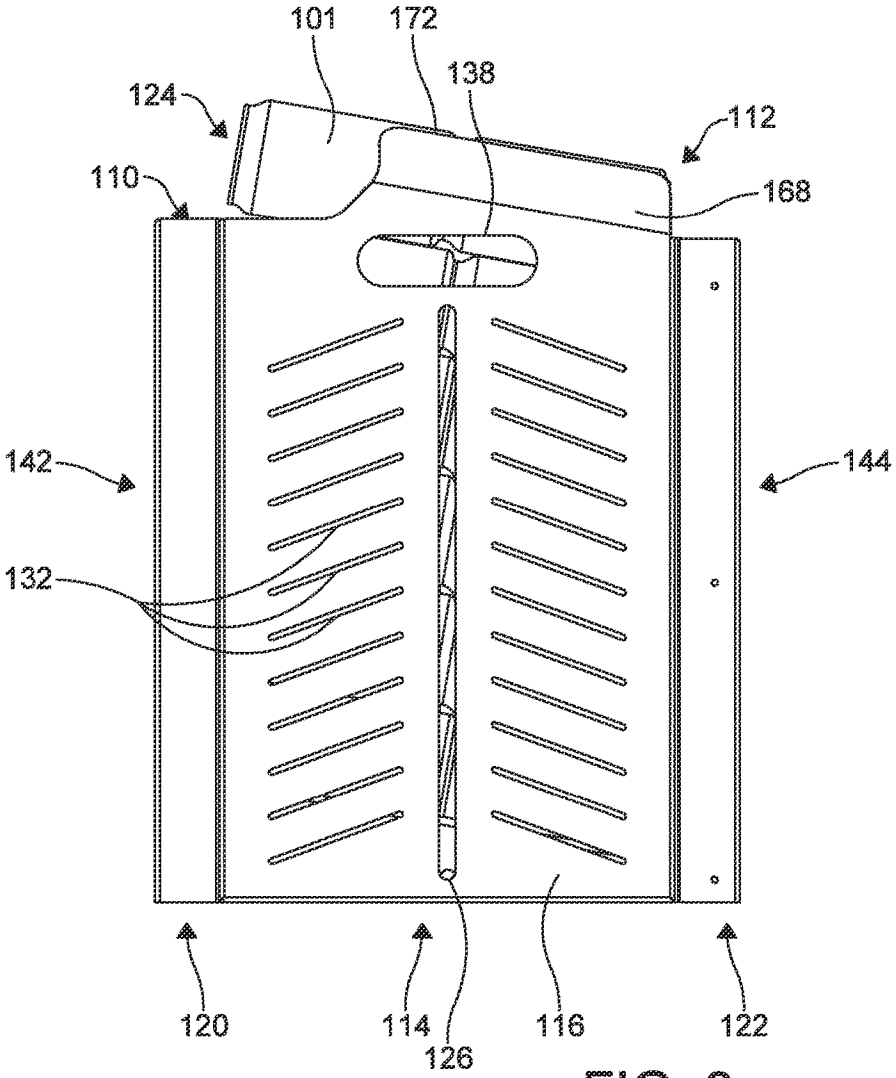
FIG. 3 is a right side elevational view of the container for retaining and dispensing items shown in FIG. 1.

With reference to FIGS. 1-3, and 11-12, the container 100 for retaining and dispensing the items 101 may have one or more first elongate vents 132 on the first side 116, and one or more second elongate vents 134 on the second side 118. The first elongate vents 132 may be disposed on opposite sides of the first elongate slot 126, and oriented transverse to an orientation of the first elongate slot 126, for example, as shown in FIGS. 1-3. The second elongate vents 134 may be disposed on opposite sides of the second elongate slot 128, and oriented transverse to an orientation of the second elongate slot 128, for example, as shown in FIGS. 11-12. Each of the first elongate vents 132 and the second elongate vents 134 may be configured to facilitate temperature control such as cooling or heating the items 101 and/or drainage of the cavity 110 of the main body 102 in operation. For example, the first and second elongate vents 132, 134 may allow ice water and/or cool air to permeate the cavity 110 of the main body 102. Likewise, this allows for the items 101 inside of the container 100 for retaining and dispensing the items 101 to be cooled rapidly. The size and/or shape of the elongate vents 132, 134 may militate against the container 100 for retaining and dispensing the items 101 from filling with ice. When the container 100 for retaining and dispensing the items 101 is taken out of an ice chest filled with ice and water, the elongate slots 126, 128 and elongate vents 132, 134 may allow for faster drainage from the cavity 110 of the container 100 for retaining and dispensing the items 101. Furthermore, the user may utilize the elongate vents 132, 134, and/or the elongate slots 126, 128, to visually confirm the number of the items 101 within the container 100 for retaining and dispensing the items 101, as desired.

With renewed reference to FIGS. 1-3 and 12-14, the container 100 for retaining and dispensing the items 101 may include a first handle hole 138 on the first side 116. The first handle hole 138 is disposed adjacent the top side 112 of the main body 102, as shown in FIGS. 1-3 and 13-14. The second side 118 may also have a second handle hole 140 disposed adjacent the top side 112 of the main body 102, as shown in FIG. 12. The first handle hole 138 and the second handle hole 140 may together permit the user to manually move the main body 102.

Referring now to FIGS. 1-14, the container 100 for retaining and dispensing the items 101 may further include a first rail portion 142 at the first end 120, and a second rail portion 144 at the second end 122. As illustrated in FIGS. 13-14, each first rail portion 142 and second rail portion 144 is configured to selectively slidably secure the main body 102 when in a stored position 146.

As depicted in FIGS. 4, 7, 8, and 12, certain embodiments of the container 100 for retaining and dispensing the items 101 may include a first notch 148 on the first end 120. The first notch 148 may be configured to receive a first spacer (not shown). The first notch 148 may be disposed adjacent the first rail portion 142. The second end 122 may also have a second notch 152 configured to receive a second spacer (not shown). The second notch 152 may be disposed adjacent to the second rail portion 144. The first spacer and the second spacer may be configured to militate against an undesired movement of the main body 102 when in the stored position 146, particularly when used in tandem with other devices (such as the holders, the coolers, and other containers or container systems 242, 252, 254, 250 shown in FIGS. 12-14).

Figure 5:
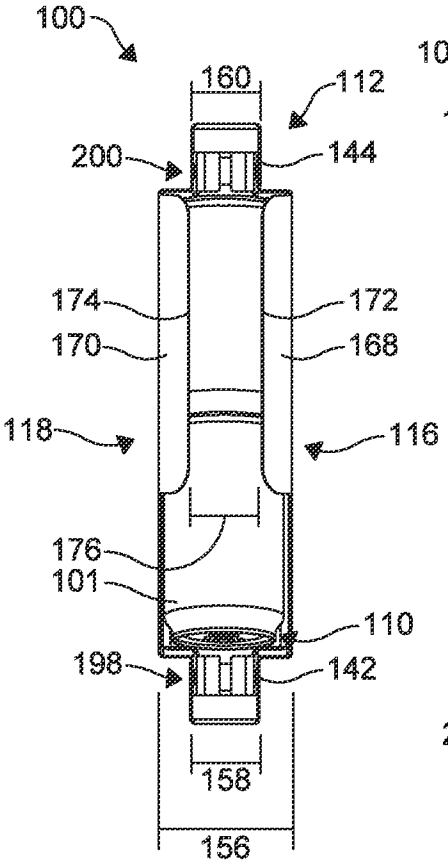
FIG. 5 is a top plan view of the container for retaining and dispensing items shown in FIG. 1.

With renewed reference to FIG. 5, the main body 102 of the container 100 for retaining and dispensing the items 101 may have a main body width 156. The first rail portion 142 may have a first rail portion width 158. The second rail portion 144 may have a second rail portion width 160. The main body width 156 may be greater than each of the first rail portion width 158 and the second rail portion width 160. In a nonlimiting example, the first rail portion width 158 may be the same as the second rail portion width 160. It should be appreciated the relative differences in the main body width 156 compared to the first rail portion width 158 and the second rail portion width 160 may allow the container 100 for retaining and dispensing the items 101 to be selectively slidably secured in various stored positions 146, as shown in FIGS. 13 and 14.

With renewed reference to FIG. 12, certain examples of the container 100 for retaining and dispensing the items 101 may have the main body 102 formed from a first side body 162, which may define the first side 116 of the main body 102, and a second side body 164, which may define the second side 118 of the main body 102. The first side body 162 may be affixed to the second side body 164 at the first rail portion 142 at the first end 120 of the main body 102, for example. Additionally, the first side body 162 may be affixed to the second side body 164 at the second rail portion 144 at the second end 122 of the main body 102. In a further embodiment, the first side body 162 and the second side body 164 may be affixed with mechanical fasteners 166. The mechanical fasteners 166 may be disposed at the first end 120 of the main body 102 and the second end 122 of the main body 102. In some embodiments, the mechanical fasteners 166 may be rivets. One of skill in the art may also select other suitable types of the mechanical fasteners 166, as desired.

As illustrated in FIGS. 1-5, 7-8, 10, and 12-14, certain embodiments of the container 100 for retaining and dispensing the items 101 may include a first curved retaining wall 168. The first curved retaining wall 168 may on the first side 116 of the main body 102, and disposed adjacent the dispensing opening 124. Similarly, the second side 118 of the main body 102 and may include a second curved retaining wall 170. The second curved retaining wall 170 may be disposed adjacent to the dispensing opening 124. As shown in FIG. 12, the first curved retaining wall 168 may face the second curved retaining wall 170.

Together, the first curved retaining wall 168 and the second curved retaining wall 170 may militated against the items 101 being dispensed other than substantially laterally from the cavity 110 of the main body 102. Advantageously, this may allow the user to transport the container 100 for retaining and dispensing the items 101 when the container 100 is full of the items 101, thereby militating against an unintentional dispensing of the items 101.

Certain examples of the container 100 for retaining and dispensing the items 101 may allow the user to quickly unload the contents of the container 100 for retaining and dispensing the items 101 by tilting the container 100 for retaining and dispensing the items 101 forward toward the first end 120, allowing items 101 to slide out in quick succession. As the items 101 slide out, the springs 106, 108 may continuously rechamber the items 101, allowing the user to selectively unload the contents of the container 100 for retaining and dispensing the items 101. This may allow users to swap items 101 or to lessen the weight of the container 100 for retaining and dispensing the items 101 by reducing the number of items 101 in the container 100 for retaining and dispensing the items 101.

Figure 4:
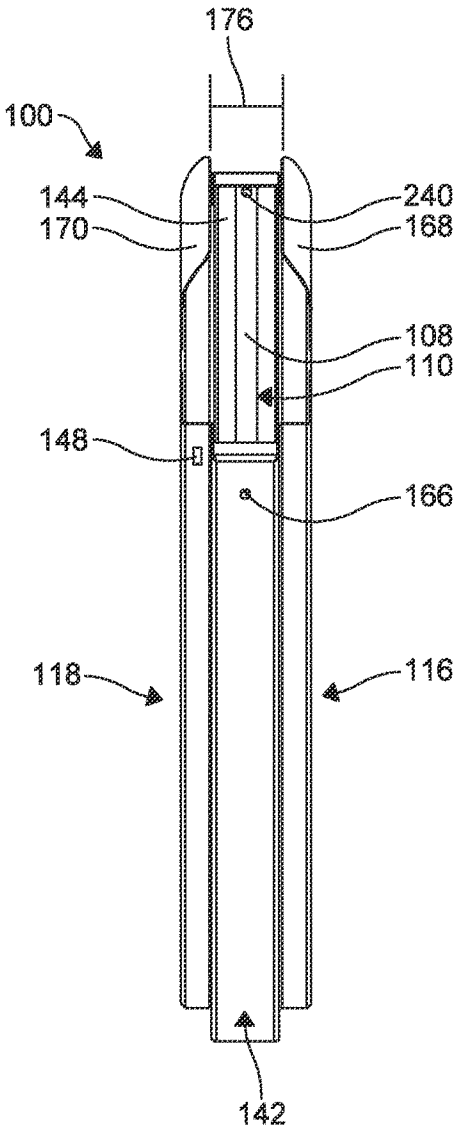
FIG. 4 is a top perspective view of the container for retaining and dispensing items shown in FIG. 1, and further illustrated without items present in order to show an underlying attachment of a spring member to an inner surface of the container.
Figure 8:
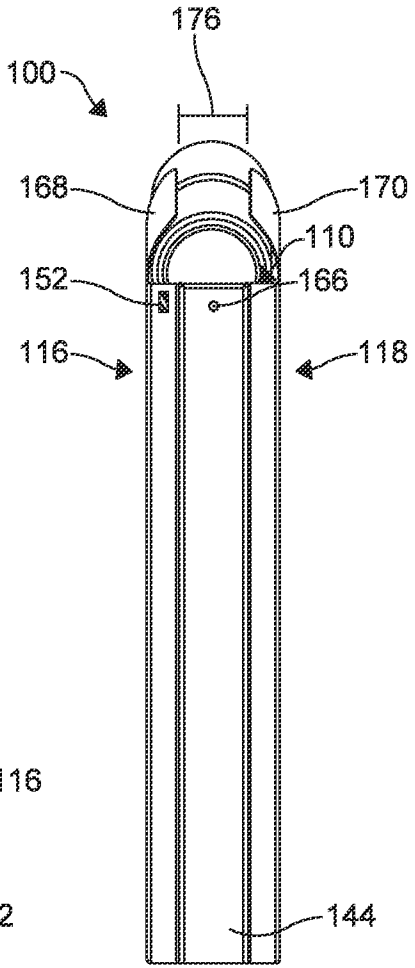
FIG. 8 is a rear elevational view of the container for retaining and dispensing items shown in FIG. 1.

As illustrated in FIGS. 4 and 8, further embodiments of the container 100 for retaining and dispensing the items 101 may include a first free edge 172 on the first curved retaining wall 168, and a second free edge 174 on the second curved retaining wall 170. The first free edge 172 may be spaced apart from the second free edge 174 and define a gap 176 between them. The gap 176 may be disposed adjacent to the dispensing opening 124 and may be configured to permit the user to slide the items 101 substantially laterally toward the dispensing opening 124. In certain embodiments, the free edges 172, 174 may extend past the curved retaining walls 168, 170 allowing a user to have improved manual access to grasp or slide the items 101 from the container 100.

With reference to FIGS. 9-12, the tray 104 of the container 100 is selectively movably disposed within the cavity of the main body 102 and configured to support the items 101. As shown in FIG. 12, the tray 104 may have a tray body 178 with an upper surface 180, a bottom surface 182, a first tray end 184, a second tray end 186, a first tray side 188, and a second tray side 190. In some embodiments, the upper surface 180 may be concave and configured to support the items 101. In further embodiments, the upper surface 180 may have a recess configured to hold specific shapes such as standard 12-ounce cans, 16-ounce cans, 32-ounce cans, 12-ounce bottles, wine bottles, and the like.

Figure 9:
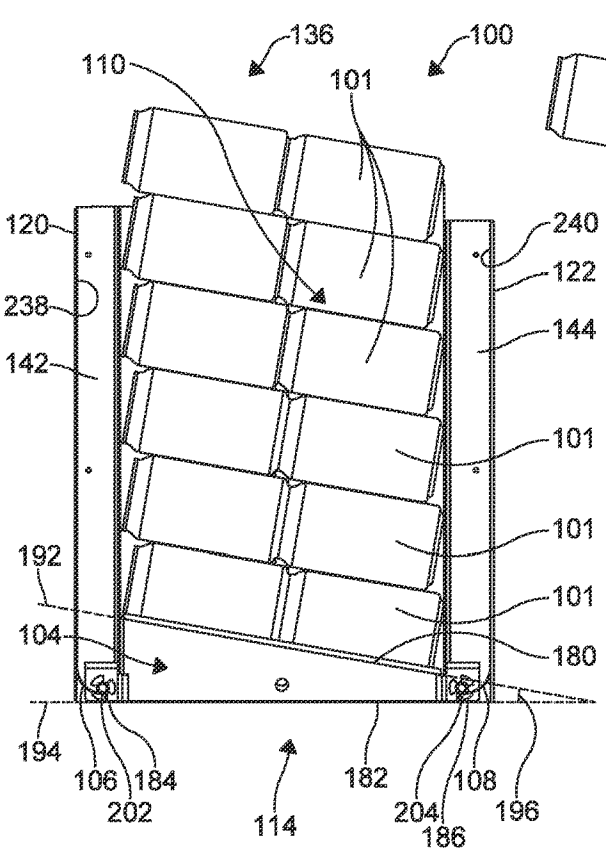
FIG. 9 is a cross-sectional right side elevational view of the container for retaining and dispensing items taken at section line A-A in FIG. 1, and showing the container fully loaded with the items and the tray at a bottom of the container in a loading position, and attached to spring member on right and left sides, with the spring members being fully extended.

As shown in FIG. 9, the upper surface 180 of the tray 104 may be oriented on a first plane 192. The bottom surface 182 may be oriented on a second plane 194. The first plane 192 and the second plane 194 may define a tray angle 196. The tray angle 196 may correspond to the curved retaining walls 168, 170 or the free edges 172, 174 allowing the contents of the container 100 for retaining and dispensing the items 101 to be secured against the curved retaining walls 168, 170 or the free edges 172, 174. In one example, the tray angle 196 may be between one degree (1°) and twenty degrees (20°). In a particular example, the tray angle 196 may be between five degrees (5°) and fifteen degrees (15°). In a most particular example, the tray angle 196 may be about ten degrees (10°). One of ordinary skill in the art may select other suitable angles for the tray angle 196 within the scope of the present disclosure.

With renewed referenced to FIGS. 2, 6, and 9-12, the tray 104 of the container 100 for retaining and dispensing the items 101 may have a first wheel well 198 at the first tray end 184, and a second wheel well 200 at the second tray end 186. The first wheel well 198 may rotatably house a first wheel 202. The second wheel well 200 may rotatably house a second wheel 204. In certain examples, the first wheel well 198 may have a pair of first axle slots 206, and the second wheel well 200 may have a pair of second axle slots 208.

Figure 6:
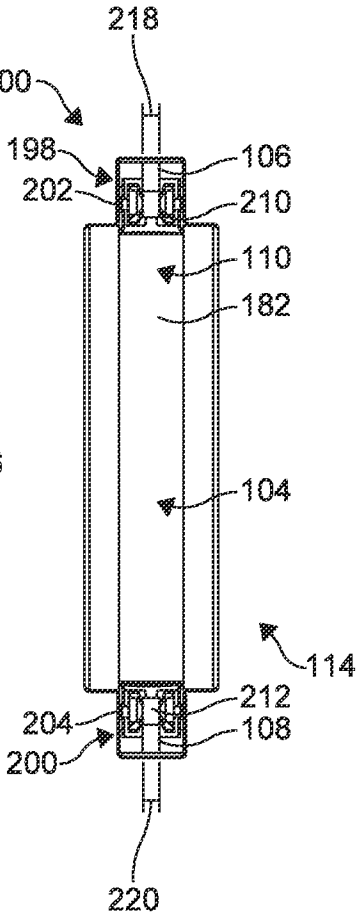
FIG. 6 is a bottom plan view of the container for retaining and dispensing items shown in FIG. 1.

In certain examples, as shown in FIGS. 6 and 12, the first wheel 202 may have a first wheel axle 210, which may be disposed within the first axle slots 206 of the first wheel well 198. The second wheel 204 may have a second wheel axle 212, which may be disposed within the second axle slots 208 of the second wheel well 200. Each of the first wheel 202 and the second wheel 204 may have a first segment 214 and a second segment 216. The first segment 214 and the second segment 216 of the first wheel 202 may be spaced apart and connected by the first wheel axle 210, defining a first wheel gap 218, as shown in FIGS. 6 and 12. The first segment 214 and the second segment 216 of the second wheel 204 may be spaced apart and connected by the second wheel axle 212, defining a second wheel gap 220, as also shown in FIGS. 6 and 12. It should be appreciated that the first and second wheel gaps 218, 220 may allow the wheels 202, 204 to take be non-uniform shapes such as cogs, permutations with selective contact points on the outer circumference of the wheel, and other appropriate variations that are known to those of skill in the art.

Renewing the reference to FIGS. 1-14, the first tray side 188 of the container 100 for retaining and dispensing the items 101 may further include a first load assist hole 222. The first load assist hole 222 may be formed through the first tray side 188 and disposed between the first tray end 184 and the second tray end 186. The second tray side 190 may further include a second load assist hole 224 formed through the second tray side 190 and disposed between the first tray end 184 and the second tray end 186. In particular, the first load assist hole 222 may be in communication with the second load assist hole 224. Upon the tray 104 being assembled within the main body 102 of the container 100, the first load assist hole 222 may be disposed adjacent the first elongate slot 126, and the second load assist hole 224 may be disposed adjacent the second elongate slot 128.

In further embodiments, as shown in FIG. 12, the first load assist hole 222 and the second load assist hole 224 may be configured to receive the load assist rod 130 when disposed through the first elongate slot 126 and the second elongate slot 128 to facilitate loading the cavity 110 of the main body 102 with the items 101. In operation, the user may apply a downward force to the load assist rod 130 to place the tray 104 in the loading position 136 as shown in FIG. 9. It should be appreciated that the first and second load assist holes 222, 224 may be in communication and aligned with (e.g., directly lined up with) the elongate slots 126, 128.

As depicted in FIGS. 9-12, the user may accomplish placing the tray 104 in the loading position 136 by manually applying pressure to the load assist rod 130 to depress the tray 104. The user may then hold the tray 104 in the loading position 136 by exerting force through the load assist rod 130, for example, by stepping on or placing another external force on the load assist rod 130. The downward external force placed on the load assist rod 130, and likewise the tray 104, may enable the user to insert items 101 into the cavity 110, thereby advantageously allowing the user the use of one or both hands of the user for the loading operation. The user may then release the tray 104 and remove the load assist rod 130 from the main body 102. In certain examples (not shown), the main body 102 may also have a receiver (not shown) for storage of the load assist rod 130 when not being used.

As illustrated in FIGS. 9-12, certain examples of the container 100 may include at least one spring member 106, 108 coupled to the main body 102. The at least one spring member 106, 108 is configured to bias the tray 104 toward the top side 112 of the main body 102. The at least one spring member 106, 108 may selectively move the tray 104 toward the top side 112 of the main body 102 upon the user dispensing the items 101 from the dispensing opening 124, for example. The first tray side 188 may be spaced apart from the second tray side 190 to define a hollow interior 228 (shown in FIG. 2) of the tray 104, which may house the at least one spring member 106, 108 that biases the tray 104 toward the top side 112 of the main body 102.

With reference to FIGS. 2, 6, and 9-12, in certain embodiments the at least one spring member 106, 108 includes a first spring member 106 and a second spring member 108. The first spring member 106 may be coupled to each of the first end 120 of the main body 102 and the first tray end 184 of the tray 104. The second spring member 108 may be coupled to each of the second end 122 of the main body 102 and the second tray end 186 of the tray 104.

Figure 10:
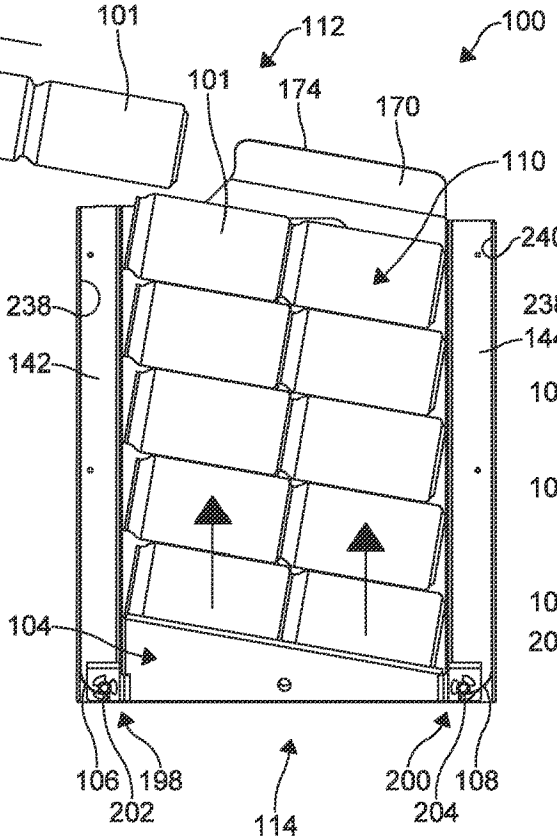
FIG. 10 is a cross-sectional right side elevational view of the container for retaining and dispensing items taken at section line A-A in FIG. 1, and showing a topmost pair of the items being removed in the direction shown by an arrow, with the tray at the bottom also moving in the direction shown by arrows by a biasing of the tray via the spring members.

As shown in FIG. 12, each of the first spring member 106 and the second spring member 108 has a top end 230, 234 and a bottom end 232, 236. The top end 230 of the first spring member 106 may be coupled to the first end 120 of the main body 102 adjacent the top side 112 of the main body 102, for example, as shown in FIGS. 9-11. The bottom end 232 of the first spring member 106 may be coupled to the first tray end 184 of the tray 104, as also shown in FIGS. 9-11. The top end 234 of the second spring member 108 may be coupled to the second end 122 of the main body 102 adjacent the top side 112 of the main body 102, as shown in FIGS. 9-11. The bottom end 236 of the second spring member 108 may be coupled to the second tray end 186 of the tray 104, as also shown in FIGS. 9-11.

Figure 7:
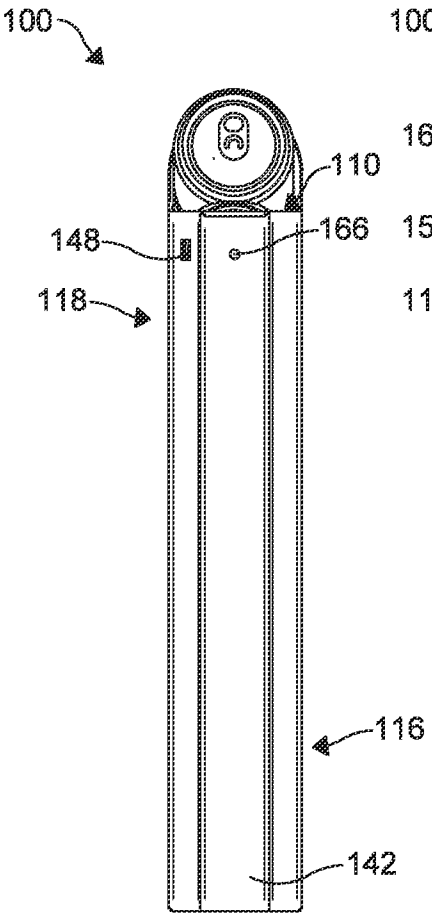
FIG. 7 is a front elevational view of the container for retaining and dispensing items shown in FIG. 1.

In certain examples, as shown in FIGS. 7-11, the top end 230 of the first spring member 106 may be coupled to an inner surface 238 of the first end 120 of the main body 102 adjacent the top side 112 of the main body 102. Similarly, the top end 234 of the second spring member 108 may be coupled to an inner surface 240 of the second end 122 of the main body 102 adjacent to the top side 112 of the main body 102. In a further example, the top end 230 of the first spring member 106 is coupled to the inner surface 238 of the first end 120 of the main body 102 with the mechanical fastener 166, as shown in FIG. 7. Likewise, the top end 234 of the second spring member 108 may be coupled to an inner surface 240 of the second end 122 of the main body with a mechanical fastener 166, as shown in FIG. 8.

As illustrated by FIG. 4 and FIG. 12, the bottom end 236 of the second spring member 108 may be disposed in the second wheel gap 220, and the top end 234 of the second spring member 108 may be joined by the mechanical fastener 166 to the inner surface 240 of the second end 122 of the main body 102 at the top of the second rail portion 144. Likewise, the first spring member 106, may be similarly disposed in the first wheel gap 218 and the top end 230 of the first spring member 106 may be joined by the mechanical fastener 166 to the inner surface 238 of the first end 120 of the main body 102 at the top of the first rail portion 142. Other suitable means for connecting the first and second spring members 106, 108 to both the main body 102 and the tray 104 may also be employed within the scope of the present disclosure.

In a further embodiment, each of the first spring member 106 and the second spring member 108 may be a constant force spring 226. When the first spring member 106 is the constant force spring 226, the first spring member 106 may be wrapped around the first wheel axle 210 in the first wheel gap 218, allowing the first spring member 106 to be releasably fastened or affixed. Similarly, when the second spring member 108 is a constant force spring 226, the second spring member 108 may be wrapped around the second wheel axle 212 in the second wheel gap 220, allowing the second spring member 108 to be releasably fastened or affixed.

The spring members 106, 108 may be formed from a variety of different materials including, as non-limiting examples, elastomers, polymers, alloys, and other suitable materials known to those with skill in the art. In further examples, the at least one spring member 106, 108 may be a constant force spring 226, a pre-stressed flat strip of spring material which is formed into virtually constant radius and coils around itself. A skilled artisan may select any suitable type of spring type and material, as desired.

With renewed reference to FIGS. 13-14, the container system 242 for retaining and dispensing items 101 may include a second container 100' for retaining and dispensing the items 101' and a holder 250. In these examples, wherein the second container 100' is present, the container 100 may be identified as the first container 100. For purposes of simplicity, it should be appreciated that the second container 100' may have the same or similar structure to that employed with the first container 100, as described hereinabove.

Advantageously, the holder 250 selectively secures the second container for retaining and dispensing items 100' in a stored position 146. The holder 250 can include any suitable structure for securely containing or holding the first container 100 and the second container 100' including, as non-limiting examples, a bracket 252, 254, a base body 258, and a cooler 260. Other suitable structures for holding the first container 100 and the second container 100' may also be used within the scope of the disclosure.

As illustrated by FIG. 12, the holder 250 of the container system 242 may further include the at least one bracket 252, 254. Likewise, the container system 242 may include a first rail portion 142 on the first end 120 of the container 100 for retaining and dispensing the items 101 and a second rail portion 144 on the second end 122 of the container 100 for retaining and dispensing the items 101. The at least one bracket 252, 254 includes a first bracket 252 which may receive the first rail portion 142 and allows the first rail portion 142 to be selectively slidably disposed in the first bracket 252. Together, the first rail portion 142 and the first bracket 252 may selectively slidably secure the main body 102 of the first container for retaining and dispensing items 100 within the stored position 146.

As also shown in FIG. 12, the container system 242 may further include a second bracket 254. The second rail portion 144 may be selectively slidably disposed in the second bracket 254. This may allow the first rail portion 142, the second rail portion 144, the first bracket 252, and the second bracket 254 to work together, allowing the main body 102 of the first container for retaining and dispensing items 100 to be selectively slidably secured in the stored position 146.

With continued reference to FIG. 12, the at least one bracket 252, 254 includes the first bracket 252 spaced apart from the second bracket 254, which allows the holder 250 to selectively slidably receive both the first container 100 for retaining and dispensing the items 101 and the second container 100' for retaining and dispensing the items 101' in each respective one of the first and second brackets 252, 254.

The bracket 252, 254 may also contain an elastomeric layer, polymers, and the like, which may be adapted to cushion one or more brackets 252, 254 or provide additional stability for the holder 250 and the container system 242. In certain examples, the brackets 252, 254 may have pads 256 that cushion and stabilize the holder 250 at the base and the rear of the holder 250. In further embodiments, the spacers 150, 154 may be selectively received within the notch 148, 152 and militate the movement of the container system 242 by allowing the holder 250 to slidably receive the container 100 for retaining and dispensing items 101 and obstructing the movement or removal of the second container 100' for retaining and dispensing the items 101'. The spacers 150, 154 may be formed out of a number of suitable materials evident to those skilled in the art including elastomers, polymers, etc.

As illustrated by FIGS. 13-14, the container system 242 may include a holder 250 which is a base body 258 configured to support the first container 100 for retaining and dispensing the items 101 in a substantially upright position. The base body 258 may have a first recess 262 formed within it, allowing the first container 100 for retaining and dispensing the items 101 to be disposed in the first recess 262. The container system 242 may further include the second container 100' for retaining and dispensing the items 101'. With reference to FIG. 13, other examples of the holder 250 may be disposed within or integral with a cooler 260 in which one or more of the containers 100, 100' for retaining and dispensing the items 100, 101' may be disposed.

With renewed reference to FIG. 12-14, embodiments of the holder 250 may include additional brackets 252, 254 or recesses, which may accommodate more of the containers 100, 100' for retaining and dispensing the items 101, 101'. It should also be appreciated that the holder 250 may be used within refrigeration units, coolers, and the like. In particular, the base body 258 may be disposed in the cooler 260, allowing the base of one or more container 100, 100' for retaining and dispensing items to nest into the recesses 262 of the base body 258 and stabilizing the containers 100, 100' for retaining and dispensing items 101, 101'. In certain examples, the holder 250 may be either permanently or removably attached to the cooler 260. In further examples, the cooler may have recesses 262 that are integral with the bottom of the cooler. Similarly, other examples may have one or more brackets 252, 254, which are permanently or removably attached to the cooler 260, allowing the user to slidably receive one or more containers 100, 100' for retaining and dispensing items the 101, 101'.

The holder 250 may further include pads 256 (shown in FIG. 12) which may be located on any of the sides of the holder 250, including the rear of the holder 250 or the sides of the holder 250. The pads 256 may be elastomeric bumpers, felt, or made out of other materials suitable for this purpose which would be evident to those of skill in the art. The pads 256 may lessen the impact from the movement of the containers 100, 100' for retaining and dispensing items 101, 101' and/or provide additional stabilizing forces for the container system 242. This may be particularly useful for container systems 242 that utilize holders 250 with brackets 252, 254, which slidably receive and release the containers 100, 100' for retaining and dispensing items 101, 101'. When the user removes or places the container system 242 on or within surfaces such as glass, the pads 256 may militate against the surface sustaining damage or militate against the container system 242 slipping or tipping. The pads 256 may be replaceable and fitted through appropriate receiving points with any number of appropriate connectors and releasable fastening elements. In other examples, the pads 256 may be integral with or permanently affixed to the container system 242 or the holder 250 through mechanical, chemical, or other suitable means.

With reference to FIG. 15, the method 300 for retaining and dispensing items 101 includes a step 302 of providing the container 100 as described hereinabove. The method 300 further includes a step 304 of loading the container 100 with the items 101 by inserting the items 101 through the dispensing opening 124 and onto the tray 104. The method 300 then includes a step 306 of manually removing individual ones of the items 101 from the container 100 through the dispensing opening 124, whereby the tray 104 is automatically caused to move toward the top side 112 of the main body 102 to position other ones of the items 101 for dispensing.

The step 304 in method 300 may further include a step of holding the tray 104 in the loading position 136 manually, and a step of inserting the items 101 into the cavity 110 of the container 100 through the dispensing opening 124. Then, the method 300 may further includes a step of releasing the tray 104 upon completion of the inserting of the items 101 into the cavity 110 of the container 100, whereby the step 304 of loading the container 100 is completed.

Advantageously, the container 100, 100' is suitable for retaining and dispensing the items 101, 101'. The container 100, 100' allows the user to conveniently take out one or more of the items 101, 101' at once, and is also simple and top dispensing for placement into the cooler or refrigeration unit. The container 100, 100' allows also allows the user to easily retrieve individual or multiple items 101, 101' from the cooler or another container. The container 100, 100' allows further allows the user to dispense the items 101, 101' with ease once the container 100, 100' is taken out of an ice chest or refrigeration unit, which allows the contents to contact the coldest parts of the ice chest or refrigeration unit, Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions, and methods may be made within the scope of the present technology, with substantially similar results.

What is claimed is:

1. A container for retaining and dispensing items, comprising:

a main body with a cavity configured for the retaining of the items, the main body having a top side, a bottom side, a first side, a second side, a first end, and a second end, the top side of the main body having a dispensing opening configured for the dispensing of the items;

a tray selectively movably disposed within the cavity of the main body and configured to support the items, the tray having a tray body with an upper surface, a bottom surface, a first tray end, a second tray end, a first tray side, and a second tray side; and at least one spring member coupled to the main body and the tray and configured to bias the tray toward the top side of the main body and to selectively move the tray toward the top side of the main body upon dispensing of the items by a user from the dispensing opening, wherein the first end has a first rail portion, and the second end has a second rail portion, each of the first rail portion and the second rail portion configured to selectively slidably secure the main body within a stored position, and wherein the first end has a first notch configured to receive a first spacer, the first notch disposed adjacent the first rail portion, and the second end has a second notch configured to receive a second spacer, the second notch disposed adjacent the second rail portion, first spacer and the second spacer configured to militating against movement of the main body when in the stored position.

2. The container of claim 1, wherein the first side has a first elongate slot, and the second side has a second elongate slot, each of the first elongate slot and the second elongate slot disposed between the top side and the bottom side of the main body, each of the first elongate slot and the second elongate slot configured to be used with a load assist rod to facilitate holding the tray in a loading position during the loading of the cavity of the main body with the items.

3. The container of claim 2, wherein the first tray side has a first load assist hole formed through the first tray side and disposed between the first tray end and the second tray end, and the second tray side has a second load assist hole formed through the second tray side and disposed between the first tray end and the second tray end, the first load assist hole in communication with the second load assist hole.

4. The container of claim 2, where the first side of the main body has a first handle hole disposed adjacent the top side of the main body, the second side of the main body has a second handle hole disposed adjacent the top side of the main body, the first handle hole and the second handle hole permitting for a manual movement of the main body by the user.

5. The container of claim 2, wherein the first side of the main body has a first curved retaining wall disposed adjacent the dispensing opening, and the second side of the main body has a second curved retaining wall disposed adjacent the dispensing opening, the first curved retaining wall facing the second curved retaining wall, and together the first curved retainer wall and the second curved retaining wall militating against the items being dispensed other than substantially laterally from the cavity of the main body.

6. The container of claim 2, wherein the upper surface of the tray is oriented on a first plane, and the bottom surface oriented on a second plane, the first plane and the second plane defining a tray angle.

7. A container for retaining and dispensing items, comprising:

a main body with a cavity configured for the retaining of the items, the main body having a top side, a bottom side, a first side, a second side, a first end, and a second end, the top side of the main body having a dispensing opening configured for the dispensing of the items;

a tray selectively movably disposed within the cavity of the main body and configured to support the items, the tray having a tray body with an upper surface, a bottom surface, a first tray end, a second tray end, a first tray side, and a second tray side; and at least one spring member coupled to the main body and the tray and configured to bias the tray toward the top side of the main body and to selectively move the tray toward the top side of the main body upon dispensing of the items by a user from the dispensing opening, wherein the first tray end has a first wheel well, and the second tray end has a second wheel well, the first wheel well rotatably housing a first wheel, and the second wheel well rotatably housing a second wheel, and wherein the first wheel well has a pair of first axle slots, and the second wheel well having a pair of second axle slots, the first wheel having a first wheel axle disposed within the first axle slots of the first wheel well, and the second wheel having a second wheel axle disposed within the second axle slots of the second wheel well.

8. The container of claim 7, wherein each of the first wheel and the second wheel has a first segment and a second segment, the first segment and the second segment of the first wheel spaced apart and connected by the first wheel axle and defining a first wheel gap, the first segment and the second segment of the second wheel spaced apart and connected by the second wheel axle and defining a second wheel gap.

9. The container of claim 8, wherein the at least one spring member includes a first spring member and a second spring member, the first spring member coupled to each of the first end of the main body and the first tray end of the tray, and the second spring member coupled to each of the second end of the main body and the second tray end of the tray.

10. The container of claim 9, wherein each of the first spring member and the second spring member has a top end and a bottom end, the top end of the first spring member coupled to the first end of the main body adjacent the top side of the main body, and the bottom end of the first spring member coupled to the first tray end of the tray, the top end of the second spring member coupled to the second end of the main body adjacent the top side of the main body, and the bottom end of the second spring member coupled to the second tray end of the tray.

11. The container of claim 10, wherein the first tray end has a first wheel well, and the second tray end has a second wheel well, the first wheel well rotatably housing a first wheel, and the second wheel well rotatably housing a second wheel, wherein the first wheel well has a pair of first axle slots, and the second wheel well having a pair of second axle slots, the first wheel having a first wheel axle disposed within the first axle slots of the first wheel well, and the second wheel having a second wheel axle disposed within the second axle slots of the second wheel well, wherein each of the first wheel and the second wheel has a first segment and a second segment, the first segment and the second segment of the first wheel spaced apart and connected by the first wheel axle and defining a first wheel gap, the first segment and the second segment of the second wheel spaced apart and connected by the second wheel axle and defining a second wheel gap, and wherein each of the first spring member and the second spring member is a constant force spring.

12. The container of claim 11, wherein the top end of the first spring member is coupled to an inner surface of the first end of the main body with a mechanical fastener, and the top end of the second spring member is coupled to the inner surface of the second end of the main body with a mechanical fastener.

* * * * *